US012292249B2

(12) United States Patent
Salazar

(10) Patent No.: US 12,292,249 B2
(45) Date of Patent: May 6, 2025

(54) ADJUSTABLE BIPOD

(71) Applicant: Accu-Tac LLC, Rancho Cucamonga, CA (US)

(72) Inventor: Felipe Salazar, Rancho Cucamonga, CA (US)

(73) Assignee: Accu-Tac LLC, Rialto, CA (US)

( * ) Notice: Subject to any disclaimer, the term of this patent is extended or adjusted under 35 U.S.C. 154(b) by 82 days.

(21) Appl. No.: 18/354,538

(22) Filed: Jul. 18, 2023

(65) Prior Publication Data

US 2025/0027736 A1 Jan. 23, 2025

(51) Int. Cl.
*F41A 23/10* (2006.01)

(52) U.S. Cl.
CPC ..... *F41A 23/10* (2013.01)

(58) Field of Classification Search
CPC ..... F41A 23/10
USPC ..... 42/94
See application file for complete search history.

(56) References Cited

U.S. PATENT DOCUMENTS

| | | | | |
|---|---|---|---|---|
| 2,284,611 | A | 5/1942 | Barnhart | |
| 6,237,462 | B1 * | 5/2001 | Hawkes | F41A 23/12 89/41.17 |
| 6,679,158 | B1 | 1/2004 | Hawkes et al. | |
| 6,860,054 | B1 * | 3/2005 | Mosher | F41A 27/24 42/94 |
| 7,047,863 | B2 | 5/2006 | Hawkes et al. | |
| 7,798,049 | B2 | 9/2010 | Willis, Jr. | |
| 8,234,968 | B2 | 8/2012 | Hodge | |
| 8,327,570 | B2 | 12/2012 | Potterfield et al. | |
| 8,397,621 | B2 | 3/2013 | Hodge | |
| 8,413,569 | B1 | 4/2013 | Helton | |
| 9,261,226 | B2 | 2/2016 | Higashi | |
| 9,279,535 | B2 | 3/2016 | Parrott | |
| 11,396,266 | B1 | 7/2022 | Glusker et al. | |
| 11,553,789 | B2 | 1/2023 | Knapp et al. | |
| 11,555,670 | B2 * | 1/2023 | Ehrlich | F41A 23/24 |
| 2008/0034954 | A1 | 2/2008 | Grober | |
| 2011/0315834 | A1 | 12/2011 | Lukic et al. | |
| 2015/0226524 | A1 | 8/2015 | Batchvarov | |
| 2016/0186927 | A1 | 6/2016 | Parrott | |
| 2019/0145739 | A1 | 5/2019 | Jiang et al. | |
| 2022/0011070 | A1 * | 1/2022 | Ferguson, Jr. | F16F 15/08 |
| 2022/0205762 | A1 * | 6/2022 | Ehrlich | G06T 7/20 |

FOREIGN PATENT DOCUMENTS

| | | | | |
|---|---|---|---|---|
| KR | 20110134753 A | * | 6/2010 | F41A 27/26 |

* cited by examiner

*Primary Examiner* — Samir Abdosh
(74) *Attorney, Agent, or Firm* — Fish & Richardson P.C.

(57) ABSTRACT

A firearm support includes a housing, two or more legs, a column, a firearm mount, and a remote actuator. The housing including a first hydraulic cylinder. The two or more legs are pivotally coupled to and extending from the housing. The column resides at least partially within the first hydraulic cylinder. The firearm mount supports a firearm and is attached to a distal end of the column opposite the first hydraulic cylinder. The remote actuator is fluidly coupled to the first hydraulic cylinder through a hydraulic hose. The remote actuator adjusts a height of the column by moving hydraulic fluid through the hydraulic hose in response to rotation of a height adjustment knob on the remote actuator.

20 Claims, 5 Drawing Sheets

ADJUSTABLE BIPOD

TECHNICAL FIELD

This disclosure relates to legged supports, and more particularly to bipods.

BACKGROUND

Legged supports are frames with one or multiple legs that support a weight of an object. A bipod is a two-legged support that bears part or all of the weight of firearms such as rifles, carbines, machine guns, and other devices such as mortars. A bipod supports a front portion of the firearm such as the barrel, handguard, or forestock of a rifle. Bipods provide support and stability against unwanted movements while allowing pivoting movements of the firearm to aim the firearm. Methods and equipment to improve bipods are sought.

SUMMARY

Implementations of the present disclosure include a firearm support that includes a housing, two or more legs, a column, a firearm mount, and a remote actuator. The housing including a first hydraulic cylinder. The two or more legs are pivotally coupled to and extending from the housing. The column resides at least partially within the first hydraulic cylinder. The firearm mount supports a firearm and is attached to a distal end of the column opposite the first hydraulic cylinder. The remote actuator is fluidly coupled to the first hydraulic cylinder through a hydraulic hose. The remote actuator adjusts a height of the column by moving hydraulic fluid through the hydraulic hose in response to rotation of a height adjustment knob on the remote actuator.

In some implementations, the hydraulic hose has a length such that the remote actuator is positionable proximate an operator of the firearm supported on the firearm mount and operable by the operator in an aiming position. In some implementations, the hydraulic hose is longer than 20 centimeters such that the height adjustment knob is rotatable by the operator while the operator looks through a scope of the firearm. In some implementations, the hydraulic hose is between 20 and 75 centimeters long.

In some implementations, one full rotation of the height adjustment knob changes an elevation of the column between 0.1 and 1 millimeter.

In some implementations, the housing includes a spring that pushes, as the height adjustment knob is rotated in an opposite direction, the column into the first hydraulic cylinder such that the central column pushes the hydraulic fluid through the hose and into a second hydraulic cylinder of the remote actuator, retracting the column. In some implementations, the spring is disposed within the first hydraulic cylinder between a piston of the column and an inwardly-projecting shoulder of the first hydraulic cylinder.

In some implementations, the legs include telescoping legs, and the firearm mount includes a mount bracket that engages the firearm.

Implementations of the present disclosure include a firearm support that includes a linear actuator, a firearm support, and a remote actuator. The linear actuator includes a cylinder and a rod that extends and retracts with respect to the cylinder. The firearm mount is coupled to an end of the rod. The firearm mount supports a firearm. The remote actuator extends or retracts, in response to an operator input, the rod of the linear actuator by moving hydraulic fluid through a hose connected between the cylinder of the linear actuator and the remote actuator, thereby changing an elevation of the firearm supported on the firearm mount.

In some implementations, the linear actuator includes a hydraulic actuator, and the cylinder includes a first hydraulic cylinder, the remote actuator including a second hydraulic cylinder fluidly coupled to the first hydraulic cylinder through the hose and operable to move the hydraulic fluid along the hose, extending or retracting the rod and thereby changing the elevation of the firearm supported on the firearm mount. In some implementations, the second hydraulic cylinder includes a piston residing within the second hydraulic cylinder. The piston is movable as a function of the operator input to push the hydraulic fluid to the first hydraulic cylinder and extend the rod or receive a portion of the hydraulic fluid and retract the rod. In some implementations, the piston is movable by a knob threadedly attached to the second hydraulic cylinder. The piston pushes, as the knob is threaded into the second hydraulic cylinder, the hydraulic fluid through the hose so that a portion of the hydraulic fluid enters the first hydraulic cylinder, causing the rod to extend out of the first hydraulic cylinder.

In some implementations, the hose is between 20 and 75 centimeters long such that the knob is rotatable by an operator of the firearm while the operator is in an aiming position looking through a scope of the firearm.

In some implementations, one full rotation of the knob changes an elevation of the rod between 0.1 and 1 millimeter.

In some implementations, the linear actuator includes a spring that retracts the rod as the remote actuator allows a portion of the hydraulic fluid to flow into the remote actuator.

Implementations of the present disclosure include a method of adjusting a firearm. The method includes mounting the firearm on a firearm mount of a bipod assembly. The bipod assembly includes a linear actuator, two or more legs, and a remote actuator. The linear actuator includes a hydraulic cylinder and a rod that extends and retracts with respect to the hydraulic cylinder. The firearm mount is attached to an end of the rod and is configured to support the firearm. The two or more legs are coupled to and extend from the linear actuator. The remote actuator is fluidly coupled to the hydraulic cylinder through a hose and is operable to move hydraulic fluid through the hose. The method also includes actuating the linear actuator by operating the remote actuator, causing the hydraulic fluid to move through the hose and thereby extending or retracting the rod, changing an elevation of the firearm supported on the firearm mount.

In some implementations, the actuating includes actuating the linear actuator while in an aiming position.

In some implementations, the remote actuator includes a knob threadedly coupled to a housing of the remote actuator, and actuating the linear actuator includes threading the knob into the housing of the remote actuator to push hydraulic fluid through the hose and into the hydraulic cylinder, causing the rod to extend out of the hydraulic cylinder under transferred hydraulic pressure and thereby change an elevation of the firearm supported on the firearm mount. In some implementations, the linear actuator includes a spring that retracts the rod, and the actuating comprises threading the knob out of the remote actuator such that the spring pushes the rod into the hydraulic cylinder such that the rod pushes the hydraulic fluid through the hose and into the remote actuator, retracting the rod. In some implementations, rotating the knob includes rotating the knob a full rotation, changing an elevation of the rod between 0.1 and 1 millimeter.

DETAILED DESCRIPTION OF THE DISCLOSURE

The present disclosure describes a portable bipod that has a housing with a linear actuator, two legs extending from the housing, and a remote actuator or control that operates the linear actuator from a relatively short distance. The remote actuator slowly changes the elevation of a column of the linear actuator as the operator (e.g., the shooter) of the bipod actuates the remote control to precisely change the elevation of the rifle as the operator is in an aiming position. Thus, the shooter can change the elevation of the bipod while aiming or without having to reach for the bipod to make adjustments.

The subject matter described in this specification can be implemented so as to realize one or more of the following advantages. For example, the bipod of the present disclosure allows a shooter to precisely change an elevation of the rifle while in an aiming position and while looking through the scope, which can improve the shooting accuracy quickly at long distances. Additionally, the bipod can move slowly as the shooter rotates the knob, allowing the shooter to accurately aim the rifle in long-range shooting.

Figure 1:
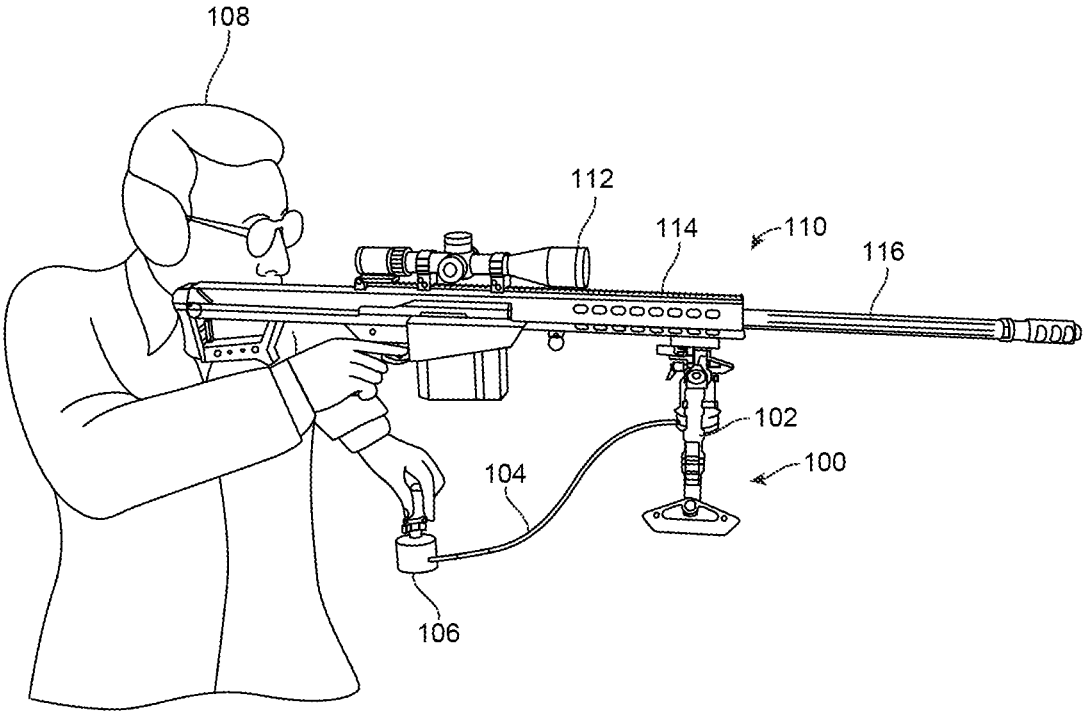
FIG. 1 is a schematic side view of a user adjusting a firearm with a bipod assembly according to an embodiment of the present disclosure.

FIG. 1 shows a bipod assembly 100 or firearm assembly that includes a bipod 102, a hose 104, and a remote actuator 106. The bipod assembly 100 is used to support a firearm 110 operated by a user or operator 108 (e.g., a shooter). The operator 108 aims using a scope 112 of the firearm 110. The bipod 102 supports a front portion of the firearm 110. For example, the bipod 102 supports a handguard 114, barrel 116, or another portion of the firearm 110 such as the forestock of a rifle. The operator 108 can adjust the elevation of the bipod 102 and thereby adjust the elevation of the firearm 110 while the operator 108 is in an aiming position (e.g., while looking through the scope 112). In some aspects, instead of a bipod 102, the firearm assembly can include a firearm support with one, three, or more legs.

Figure 2:
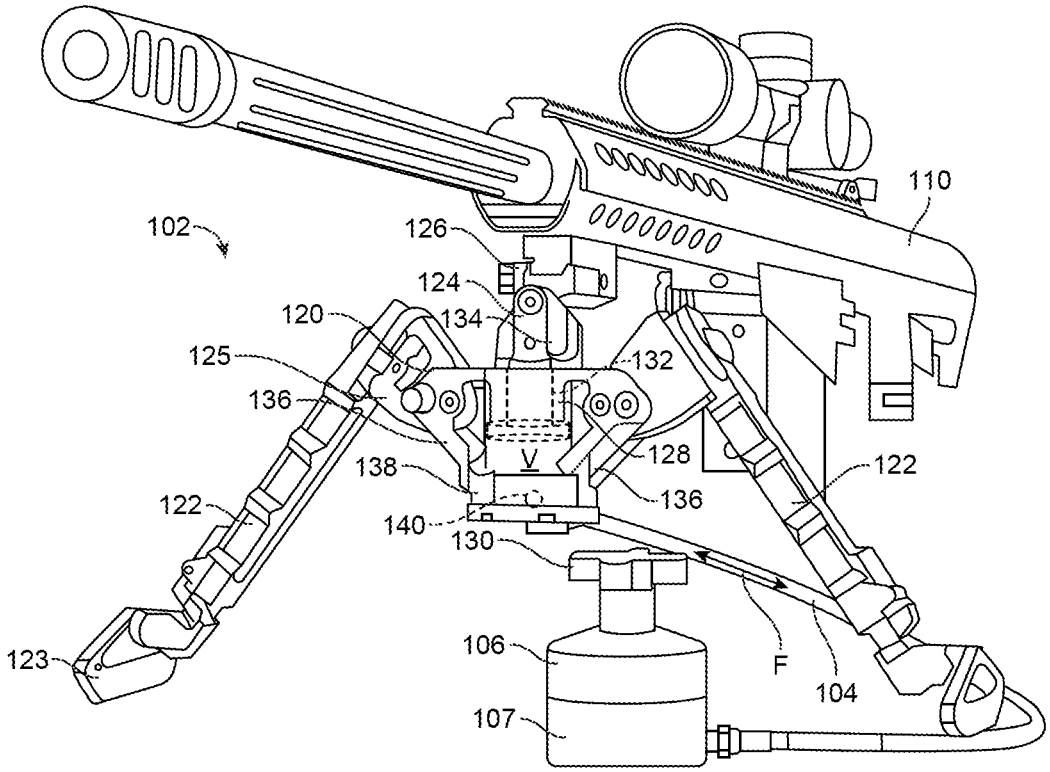
FIG. 2 is a front perspective, schematic view of the bipod assembly supporting a firearm.

Referring to FIG. 2, the bipod 102 has a housing 120, two legs 122, a column 124, and a firearm mount 126. The housing 120 is fluidly coupled, through the hose 104, to the remote actuator 106. As further described in detail below with respect to FIGS. 3-4, the remote actuator 106 adjusts a height of the column 124 by moving fluid "F" (e.g., hydraulic fluid or pneumatic fluid) through the hose 104 in response to rotation of a height adjustment knob 130 of the remote actuator 106. For example, the bipod assembly 100 includes a hydraulic or pneumatic circuit that allows the bipod 102 to be controlled from a distance.

In some aspects, the housing 120 includes a hydraulic cylinder 128, connection ends 136, and a bottom portion 138. The column 124 has a rod 132 and a head 134 attached to the rod 132. The rod 132 is at least partially disposed within the hydraulic cylinder 128. The housing 120 is made of metal (e.g., steel or aluminum) or another rigid material such as plastic. The hydraulic cylinder 128 can be formed integrally with the housing 120. The two connection ends 136 are each opposite each other and extend outwardly from the cylinder 128. Each leg 122 is pivotally attached to and extends from one of the connection ends 136. The bottom portion 138 of the housing 120 has a fluid port 140 attached to the hose 104. The bottom portion 138 has a volume "V" that receives fluid from the hose 104 through the fluid port 140 to push the rod 132 (and thereby the column 124) up, changing an elevation of the column 124.

In some aspects, the legs 122 are made of metal such as steel or aluminum or another rigid material such as plastic. The legs 122 have feet 123 that support the bipod 102 on a surface (e.g., an even or uneven surface). The feet 123 can be pivotally connected to the elongated body of the leg to allow the feet 123 to pivot and be arranged in different positions to stand firmly on uneven surfaces. Each leg 122 is a telescoping leg that extends or retracts to change an elevation of the bipod 102. The telescoping legs 122 can be extended or retracted manually.

In some aspects, each leg 122 has a connection arm 125 at an end of the elongated body of each leg and extends at an angle (e.g., at 90 degrees) with respect to the elongated body. Each connection arm 125 is connected to a respective one of the connection ends 136 of the housing 120. Each connection arm 125 and connection end 136 forms a pivot joint with a large pivot range that allows the bipod 102 to have a large footprint. For example, the bipod 102 can be opened so that the wide open angle between the legs is about 160 degrees and the distance between the two feet 123 is about 50 centimeters with the legs retracted.

The column 124 can move up and down to change an elevation of the firearm 110. Thus, the column 124 acts as a cylinder rod in a linear actuator, with the cylinder 128 housing the hydraulic fluid that pushes and extends the column 124. The head 134 of the column 124 is attached to the firearm mount 126. Thus, the firearm mount 126 is opposite the hydraulic cylinder 128. In some aspects, the firearm mount includes a support surface and an interface that attaches to or engages the firearm 110. For example, the firearm mount 126 includes a stud clamp, a mount bracket, a rail mount, or a latch that secures the bipod 102 to the firearm 110. The mount 126 can be, e.g., a sling stud mount, a Picatinny mount, an ARCA mount, or an M-Lok mount. In some implementations, the mount type can be interchangeable, e.g., to allow for different rifle configurations.

In some aspects, the remote actuator 106 is a hydraulic actuator with a second hydraulic cylinder 107. The second hydraulic cylinder 107 is fluidly coupled to the bipod's hydraulic cylinder 128 through the hose 104. The hose 104 is a hydraulic hose long enough so that the remote actuator 106 can be placed proximate the operator of the firearm while the remote actuator 106 is fluidly connected to the bipod 102. For example, the hose 104 is between 20 and 75 centimeters long (e.g., 30 to 60 centimeters long) so that the remote actuator 106 can reside near the rear end of the firearm 110 (e.g., by the trigger or stock of the firearm) while the bipod 102 supports the firearm 110. Thus, the user can operate the remote actuator 106 to change an elevation of the firearm 110 while the user is in an aiming position (e.g., while the operator looks through the scope of the firearm) or otherwise operating the firearm 110.

Figure 3:
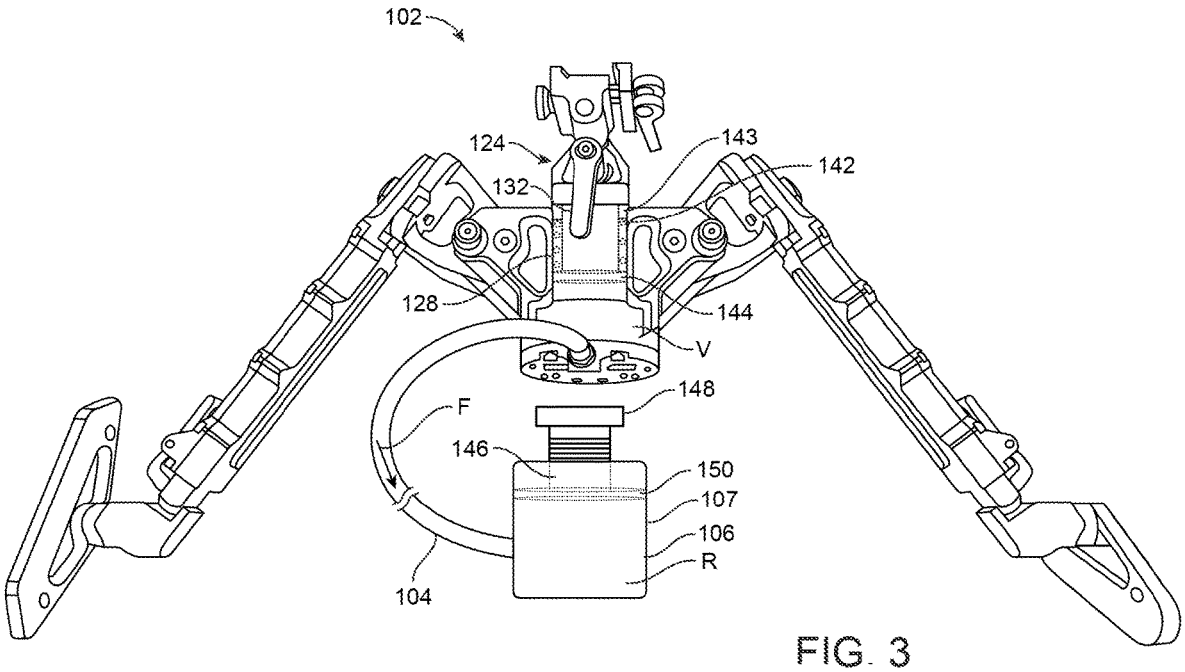
FIG. 3 is a front schematic view of the bipod assembly with a central column retracted.
Figure 4:
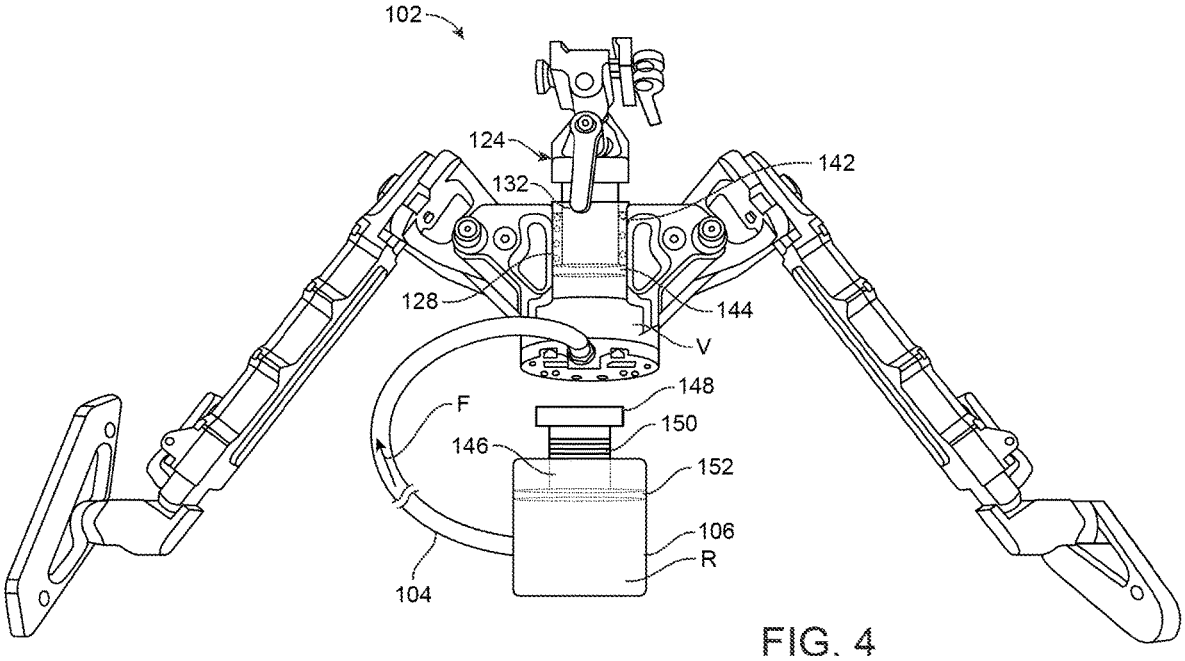
FIG. 4 is a front schematic view of the bipod assembly with the central column extended.

FIGS. 3 and 4 show sequential steps of changing an elevation of the bipod 102. In some aspects, the bipod 102 has a spring 142 that resides within the hydraulic cylinder 128 and is disposed around the rod 132. The spring 142 resides between (and bears against) a piston 144 of the rod 132 and an annular, inwardly-projecting shoulder 143 of the hydraulic cylinder 128. The spring 142 pushes the piston 144 and rod 132 downwardly, reducing the volume "V" and moving the hydraulic fluid "F" along the hose 104, pushing an amount of fluid into the remote control 106.

In some aspects, the second hydraulic cylinder 107 defines an inner volume "R." The remote control 106 also includes a threaded rod 146, a knob 148 (e.g., height-adjustment knob) fixed to an end of the threaded rod 146, and a piston 150 coupled to the opposite end of the threaded rod 146. The piston 150 resides inside the hydraulic cylinder 107 and the knob 148 resides outside of the hydraulic cylinder 107. The hydraulic cylinder 107, threaded rod 146, knob 148, and piston 150 are made of metal (e.g., steel or aluminum) or another rigid material such as plastic.

As shown in FIG. 4, the knob 148 faces up and is operable to change an elevation of the column 124. As the knob 148 is manually rotated by the operator of the firearm, the threaded rod 146 pushes the piston 150 down. As the piston 150 is pushed down, the piston 150 reduces the volume "R" and moves the fluid "F" along the hose 104, expanding the volume "V" of the first cylinder 128. As the volume "V" expands, the fluid in the volume "V" pushes the column 124 up. Thus, as the knob 148 is thread into the second hydraulic cylinder 107, the piston 150 moves the hydraulic fluid "F" through the hose 104 and pushes fluid "F" into the cylinder 128, causing the hydraulic fluid "F" to push and extend the central column 124. As the central column 124 extends, the elevation of the firearm mount increases, increasing the elevation of the firearm.

Similarly, as shown in FIG. 3, as the threaded rod 146 is threaded out of the second cylinder 107, the fluid "F" moves backwards from the bipod 102 to the remote control 106, decreasing the volume "V" and increasing the volume "R." The spring 142 pushes the piston 144 downward, helping move the hydraulic fluid "F" through the hose 104 and into the second hydraulic cylinder 107, thereby retracting the central column 124. The spring 142 pushes the piston 144 down, which can help push the fluid "F" back to the remote control 106 as the knob 148 is threaded out.

The remote controller 106 allows precise control of the elevation of the firearm. For example, the thread of the threaded rod 146 can be a fine thread and the sizes of the hydraulic cylinders 128, 107 can be sized such that rotation of the knob 148 causes "micro changes" (or micro steps) in the elevation of the column 124. For example, one full rotation of the knob 148 changes an elevation of the central column between 0.1 and 1 millimeter.

In some cases, the bipod can be controlled with a pneumatic circuit similar to the hydraulic circuit described herein. In some cases, the bipod can include an electric linear actuator and the remote control is an electric remote control connected to the electric linear actuator through a cable or wirelessly. The electric control remotely controls, in response to an operator input, the electric linear actuator to change an elevation of the column.

Figure 5:
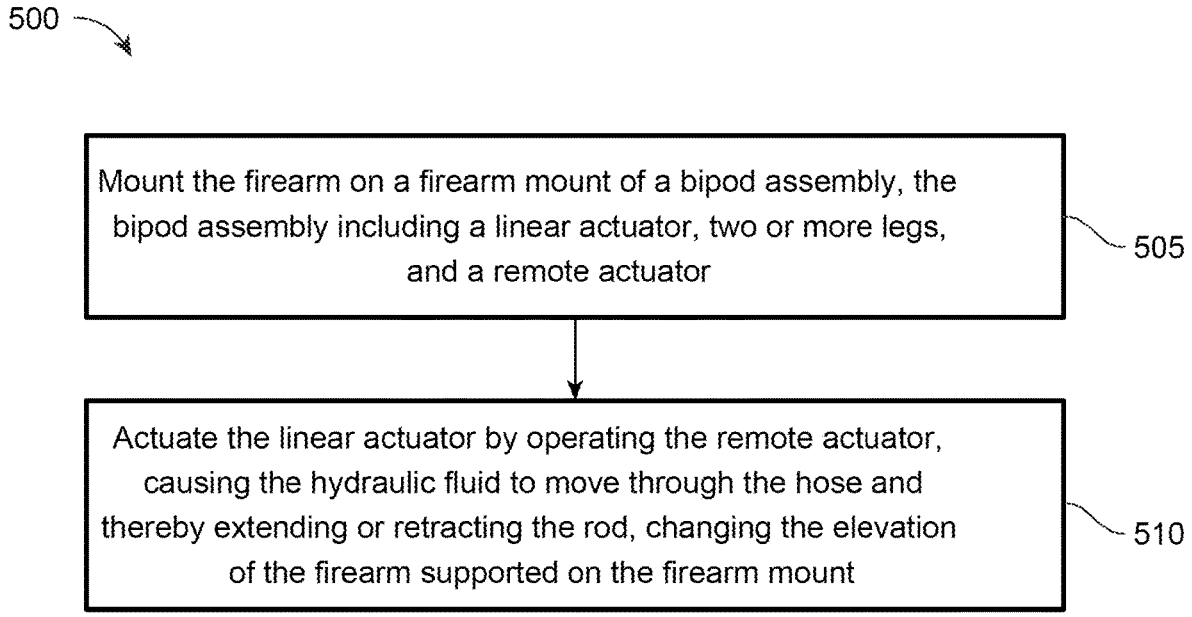
FIG. 5 is a flow chart of a method of adjusting a firearm.

FIG. 5 shows a flow chart of a method (500) of adjusting a firearm. The method includes mounting the firearm on a firearm mount of a bipod assembly. The bipod assembly includes a linear actuator, two or more legs, and a remote actuator. The linear actuator includes a hydraulic cylinder and a rod that extends and retracts with respect to the hydraulic cylinder. The firearm mount is attached to an end of the rod and supports the firearm. The two or more legs are coupled to and extend from the linear actuator. The remote actuator is fluidly coupled to the first hydraulic cylinder through a hose and is operable to move hydraulic fluid through the hose (505). The method also includes actuating the linear actuator by operating the remote actuator, causing the hydraulic fluid to move through the hose and thereby extending or retracting the rod, changing the elevation of the firearm supported on the firearm mount (510).

While this specification contains many specific implementation details, these should not be construed as limitations on the scope of any inventions or of what may be claimed, but rather as descriptions of features specific to particular implementations of particular inventions. Certain features that are described in this specification in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the implementations described above should not be understood as requiring such separation in all implementations, and it should be understood that the described program components and systems can generally be integrated together in a single software product or packaged into multiple software products.

A number of implementations have been described. Nevertheless, it will be understood that various modifications may be made without departing from the spirit and scope of the disclosure. For example, example operations, methods, or processes described herein may include more steps or fewer steps than those described. Further, the steps in such example operations, methods, or processes may be performed in different successions than that described or illustrated in the figures. Accordingly, other implementations are within the scope of the following claims.

What is claimed is:

1. A firearm support, comprising:

a housing comprising a first hydraulic cylinder;

two or more legs pivotally coupled to and extending from the housing;

a column disposed at least partially within the first hydraulic cylinder;

a firearm mount configured to support a firearm and attached to a distal end of the column opposite the first hydraulic cylinder; and a remote actuator fluidly coupled to the first hydraulic cylinder through a hydraulic hose, where the remote actuator is configured to adjust a height of the column by moving hydraulic fluid through the hydraulic hose in response to rotation of a height adjustment knob on the remote actuator.

2. The firearm support of claim 1, wherein the hydraulic hose has a length such that the remote actuator is positionable proximate an operator of the firearm supported on the firearm mount and operable by the operator in an aiming position.

3. The firearm support of claim 2, wherein the hydraulic hose is longer than 20 centimeters such that the height adjustment knob is rotatable by the operator while the operator looks through a scope of the firearm.

4. The firearm support of claim 3, wherein the hydraulic hose is between 20 and 75 centimeters long.

5. The firearm support of claim 1, wherein one full rotation of the height adjustment knob changes an elevation of the column between 0.1 and 1 millimeter.

6. The firearm support of claim 1, wherein the housing comprises a spring configured to push, as the height adjustment knob is rotated in an opposite direction, the column into the first hydraulic cylinder such that the central column pushes the hydraulic fluid through the hose and into a second hydraulic cylinder of the remote actuator, retracting the column.

7. The firearm support of claim 6, wherein the spring is disposed within the first hydraulic cylinder between a piston of the column and an inwardly-projecting shoulder of the first hydraulic cylinder.

8. The firearm support of claim 1, wherein the legs comprise telescoping legs and the firearm mount comprises a mount bracket configured to engage the firearm.

9. A firearm support, comprising:

a linear actuator comprising a cylinder and a rod configured to extend and retract with respect to the cylinder;

a firearm mount coupled to an end of the rod and configured to support a firearm; and a remote actuator configured to extend or retract the rod of the linear actuator by moving hydraulic fluid through a hose connected between the cylinder of the linear actuator and the remote actuator in response to an operator input, thereby changing an elevation of the firearm supported on the firearm mount.

10. The firearm support of claim 9, wherein the linear actuator comprises a hydraulic actuator and the cylinder comprises a first hydraulic cylinder, the remote actuator comprising a second hydraulic cylinder fluidly coupled to the first hydraulic cylinder through the hose and operable to move the hydraulic fluid along the hose, extending or retracting the rod and thereby changing the elevation of the firearm supported on the firearm mount.

11. The firearm support of claim 10, wherein the second hydraulic cylinder comprises a piston residing within the second hydraulic cylinder, the piston movable as a function of the operator input to push the hydraulic fluid to the first hydraulic cylinder and extend the rod or receive a portion of the hydraulic fluid and retract the rod.

12. The firearm support of claim 11, wherein the piston is movable by a knob threadedly attached to the second hydraulic cylinder and configured to push, as the knob is threaded into the second hydraulic cylinder, the hydraulic fluid through the hose so that a portion of the hydraulic fluid enters the first hydraulic cylinder, causing the rod to extend out of the first hydraulic cylinder.

13. The firearm support of claim 12, wherein the hose is between 20 and 75 centimeters long such that the knob is rotatable by an operator of the firearm while the operator is in an aiming position looking through a scope of the firearm.

14. The firearm support of claim 12, wherein one full rotation of the knob changes an elevation of the rod between 0.1 and 1 millimeter.

15. The firearm support of claim 10, wherein the linear actuator comprises a spring configured to retract the rod as the remote actuator allows a portion of the hydraulic fluid to flow into the remote actuator.

16. A method of adjusting a firearm, the method comprising:

mounting the firearm on a firearm mount of a bipod assembly, the bipod assembly comprising:

a linear actuator comprising a hydraulic cylinder and a rod configured to extend and retract with respect to the hydraulic cylinder, the firearm mount attached to an end of the rod and configured to support the firearm;

two or more legs coupled to and extending from the linear actuator; and a remote actuator fluidly coupled to the hydraulic cylinder through a hose and operable to move hydraulic fluid through the hose; and actuating the linear actuator by operating the remote actuator, causing the hydraulic fluid to move through the hose and thereby extending or retracting the rod, changing an elevation of the firearm supported on the firearm mount.

17. The method of claim 16, wherein the actuating comprises actuating the linear actuator while in an aiming position.

18. The method of claim 16, wherein the remote actuator comprises a knob threadedly coupled to a housing of the remote actuator, and actuating the linear actuator comprises threading the knob into the housing of the remote actuator to push hydraulic fluid through the hose and into the hydraulic cylinder, causing the rod to extend out of the hydraulic cylinder under transferred hydraulic pressure and thereby change an elevation of the firearm supported on the firearm mount.

19. The method of claim 18, wherein linear actuator comprises a spring configured to retract the rod and the actuating comprises threading the knob out of the remote actuator such that the spring pushes the rod into the hydraulic cylinder such that the rod pushes the hydraulic fluid through the hose and into the remote actuator, retracting the rod.

20. The method of claim 18, wherein rotating the knob comprises rotating the knob a full rotation, changing an elevation of the rod between 0.1 and 1 millimeter.

* * * * *